US006935525B2

(12) United States Patent
Trude

(10) Patent No.: US 6,935,525 B2
(45) Date of Patent: Aug. 30, 2005

(54) CONTAINER WITH FLEXIBLE PANELS

(75) Inventor: Greg Trude, Seven Valleys, PA (US)

(73) Assignee: Graham Packaging Company, L.P., York, PA (US)

( * ) Notice: Subject to any disclaimer, the term of this patent is extended or adjusted under 35 U.S.C. 154(b) by 25 days.

(21) Appl. No.: 10/366,617

(22) Filed: Feb. 14, 2003

(65) Prior Publication Data

US 2004/0159627 A1 Aug. 19, 2004

(51) Int. Cl.[7] ..... B65D 1/02; B65D 1/10

(52) U.S. Cl. ..... 215/381; 215/382; 220/669; 220/675

(58) Field of Search ..... 215/381–384; 220/669, 675

(56) References Cited

U.S. PATENT DOCUMENTS

| | | | | |
|---|---|---|---|---|
| 3,325,031 A | * | 6/1967 | Singier | 215/247 |
| 4,372,455 A | | 2/1983 | Cochran | |
| 4,497,855 A | | 2/1985 | Agrawal et al. | |
| 4,805,788 A | | 2/1989 | Akiho | |
| 4,877,141 A | | 10/1989 | Hayashi et al. | |
| 5,141,120 A | | 8/1992 | Brown et al. | |
| 5,141,121 A | | 8/1992 | Brown et al. | |
| 5,178,290 A | | 1/1993 | Ota et al. | |
| 5,199,588 A | * | 4/1993 | Hayashi | 215/381 |
| 5,224,613 A | * | 7/1993 | Robbins, III | 215/10 |
| 5,238,129 A | | 8/1993 | Ota | |
| 5,279,433 A | * | 1/1994 | Krishnakumar et al. | 215/381 |
| D344,457 S | | 2/1994 | Prevot et al. | |
| 5,303,834 A | | 4/1994 | Krishnakumar et al. | |
| 5,337,909 A | | 8/1994 | Vailliencourt | |
| 5,341,946 A | * | 8/1994 | Vailliencourt et al. | 215/381 |
| 5,392,937 A | | 2/1995 | Prevot et al. | |
| D366,416 S | | 1/1996 | Semersky | |
| D366,417 S | | 1/1996 | Semersky | |
| D366,831 S | | 2/1996 | Semersky et al. | |
| 5,573,129 A | * | 11/1996 | Nagata et al. | 215/382 |
| 5,860,556 A | * | 1/1999 | Robbins, III | 220/666 |
| 5,908,128 A | | 6/1999 | Krishnakumar et al. | |
| 5,971,184 A | | 10/1999 | Krishnakumar et al. | |
| 6,347,717 B1 | * | 2/2002 | Eberle | 215/381 |
| 6,585,125 B1 | * | 7/2003 | Peek | 215/381 |
| 2001/0035392 A1 | * | 11/2001 | Ota et al. | |
| 2002/0070193 A1 | * | 6/2002 | Mero | |
| 2002/0104820 A1 | * | 8/2002 | Hong et al. | |
| 2003/0000911 A1 | * | 1/2003 | Kelley et al. | |
| 2003/0015491 A1 | * | 1/2003 | Melrose et al. | |
| 2004/0155008 A1 | * | 8/2004 | Lane et al. | |

FOREIGN PATENT DOCUMENTS

| | | | | |
|---|---|---|---|---|
| EP | 581724 A1 | * | 2/1994 | B65D/1/02 |
| JP | 405065158 A | * | 3/1993 | |
| WO | WO00/50309 | | 8/2000 | |
| WO | WO 00/50309 | | 8/2000 | |
| WO | WO0068095 | * | 11/2000 | |

* cited by examiner

*Primary Examiner*—Sue A. Weaver
(74) *Attorney, Agent, or Firm*—Venable LLP; James R. Burdett; Jeffri A. Kaminski

(57) ABSTRACT

A container having a central longitudinal axis, the container including at least one deflectable flexible panel, the flexible panel projecting from the longitudinal axis to pass through at least three curves including a first curve having a first constant radius, a second curve having a second varying radius, and a third curve having a third constant radius that is lesser than the first radius.

47 Claims, 4 Drawing Sheets

CONTAINER WITH FLEXIBLE PANELS

BACKGROUND OF THE INVENTION

1. Field of the Invention

The present invention generally relates to a pressure-adjustable container, and more particularly to such containers that are typically made of polyester and are capable of being filled with hot liquid. It also relates to an improved sidewall construction for such containers.

2. Related Art

The use of blow molded plastic containers for packaging "hot fill" substances is well known. However, a container that is used for hot fill applications is subject to additional mechanical stresses on the container that result in the container being more likely to fail during storage or handling. For example, it has been found that the thin sidewalls of the container deform or collapse as the container is being filled with hot fluids. In addition, the rigidity of the container decreases immediately after the hot fill liquid is introduced into the container. As the liquid cools, the liquid shrinks in volume which, in turn, produces a negative pressure or vacuum in the container. The container must be able to withstand such changes in pressure without failure.

Hot fill containers typically comprise substantially rectangular vacuum panels that are designed to collapse inwardly after the container has been filled with hot liquid. However, the inward flexing of the panels caused by the hot fill vacuum creates high stress points at the top and bottom edges of the panels, especially at the upper and lower comers of the panels. These stress points weaken the portions of the sidewall near the edges of the panels, allowing the sidewall to collapse inwardly during handling of the container or when containers are stacked together. See, for example, U.S. Pat. No. 5,337,909.

"Hot fill" applications impose significant and complex mechanical stress on a container structure due to thermal stress, hydraulic pressure upon filling and immediately after capping, and vacuum pressure as the fluid cools.

Thermal stress is applied to the walls of the container upon introduction of hot fluid. The hot fluid will cause the container walls to soften and then shrink unevenly, causing distortion of the container. The polyester typically used to form the container must therefore be heat-treated to induce molecular changes resulting in a container that exhibits thermal stability. Pressure and stress are acted upon the sidewalls of a heat resistant container during the filling process, and for a significant period of time thereafter. When the container is filled with hot liquid and sealed, there is an initial hydraulic pressure and an increased internal pressure is placed upon containers. As the liquid, and the air headspace under the cap, subsequently cool, thermal contraction results in partial evacuation of the container. The vacuum created by this cooling tends to mechanically deform the container walls.

Generally speaking, containers incorporating a plurality of longitudinal flat surfaces accommodate vacuum force more readily. Agrawal et al, U.S Pat. No. 4,497,855 discloses a container with a plurality of recessed collapse panels, separated by land areas, which allows uniformly inward deformation under vacuum force. The vacuum effects are controlled without adversely affecting the appearance of the container. The panels are drawn inwardly to vent the internal vacuum and so prevent excess force being applied to the container structure, which would otherwise deform the inflexible post or land area structures. The amount of "flex" available in each panel is limited, however, and as the limit is approached there is an increased amount of force that is transferred to the side walls.

The flexure is most commonly addressed with vacuum flex panels positioned under a label below the dome of the container. One example of containers having such vacuum flex panels is disclosed in U.S. Pat. No. 5,141,120 (Brown et al.) and U.S. Pat. No. 5,141,121 (Brown et al.), each of which is incorporated by reference. In such patents, pinch grip indentations function as the vacuum flex panels. Another example of containers having such vacuum flex panels is disclosed in U.S. Pat. No. 5,392,937 (Prevot et al.) and U.S. Des. Pat. No. 344,457 (Prevot et al.), both of which are assigned to the assignee of the present invention and hereby incorporated by reference. In those containers, a grip structure moves with the vacuum flex panel in response to vacuum induced inside the container in response to hot filling, capping and cooling of the container contents. Still another example of containers having such vacuum flex panels is disclosed in International Publication No. WO 00/50309 (Melrose), which is incorporated herein by reference. With that container, a controlled deflection vacuum flex panel inverts and flexes under pressure to avoid deformation and permanent buckling of the container. It includes an initiator portion, which has a lesser projection than the remainder of the flex panel and initiates deflection of the flex panel.

External forces are applied to sealed containers as they are packed and shipped. Filled containers are packed in bulk in cardboard boxes, or plastic wrap, or both. A bottom row of packed, filled containers may support several upper tiers of filled containers, and potentially, several upper boxes of filled containers. Therefore, it is important that the container have a top loading capability, which is sufficient to prevent distortion from the intended container shape. Dome region ovalization is a common distortion associated with hot-fillable, blow-molded plastic containers. The dome is the upper portion of the container adjacent the finish. Some dome configurations are designed to have a horizontal cross-section which is circular in shape. The forces resulting form hot-filling and top loading can change the intended horizontal cross-sectional shape, for example, from circular to oval.

Examples of hot-fillable, blow-molded plastic containers that can withstand the above referenced forces and can maintain their as-designed aesthetic appearance are the containers disclosed in U.S. Pat. Nos. Des. 366,416, 366, 417, and 366,831 all assigned to the assignee of the present application and incorporated herein by reference. The referenced design patents illustrate in phantom lines a "bell-shape" dome located between a finish and a label mounting area. The diameter of the horizontal cross-section through a bell-shaped dome increases as the dome extends downwardly from the finish. The dome diameter then decreases to an inwardly extending peripheral waist, and downwardly from the waist, the dome diameter increases before connecting with the label mounting area of the container. The bell-shape of the dome provides an aesthetic appearance as initially blow-molded, and it provides a degree of reinforcement against distortion of the dome, particularly ovalization types of distortion.

To minimize the effect of force being transferred to the side walls, much prior art has focused on providing stiffened regions to the container, including the panels, to prevent the structure yielding to the vacuum force. The provision of horizontal or vertical annular sections, or 'ribs', throughout a container has become common practice in container construction, and is not only restricted to hot-fill containers. Such annular sections will strengthen the part they are deployed upon. U.S. Pat. No. 4,372,455 (Cochran) discloses annular rib strengthening in a longitudinal direction, placed in the areas between the flat surfaces that are subjected to inwardly deforming hydrostatic forces under vacuum force. U.S. Pat. No. 4,805,788 (Ota et al.) discloses longitudinally extending ribs alongside the panels to add stiffening to the container. Ota also discloses the strengthening effect of providing a larger step in the sides of the land areas. This provides greater dimension and strength to the rib areas between the panels.

U.S. Pat. No. 5,178,290 (Ota et al.) discloses indentations to strengthen the panel areas themselves. U.S. Pat. No. 5,238,129 (Ota et al.) discloses further annular rib strengthening, this time horizontally directed in strips above and below, and outside, the hot-fill panel section of the bottle. In addition to the need for strengthening a container against both thermal and vacuum stress, there is a need to allow for an initial hydraulic pressure and increased internal pressure that is placed upon a container when hot liquid is introduced followed by capping. This causes stress to be placed on the container side wall. There is a forced outward movement of the heat panels, which can result in a barreling of the container.

Thus, U.S. Pat. No. 4,877,141 (Hayashi et al.) discloses a panel configuration that accommodates an initial, and natural, outward flexing caused by internal hydraulic pressure and temperature, followed by inward flexing caused by the vacuum formation during cooling. Importantly, the panel is kept relatively flat in profile, but with a central portion displaced slightly to add strength to the panel but without preventing its radial movement in and out. With the panel being generally flat, however, the amount of movement is limited in both directions. By necessity, panel ribs are not included for extra resilience, as this would prohibit outward and inward return movement of the panel as a whole.

U.S. Pat. No. 5,908,128 (Krishnakumar et al.) discloses another flexible panel that is intended to be reactive to hydraulic pressure and temperature forces that occur after filling. Relatively standard 'hot-fill' style container geometry is disclosed for a "pasteurizable" container. It is claimed that the pasteurization process does not require the container to be heat-set prior to filling, because the liquid is introduced cold and is heated after capping. Concave panels are used to compensate for the pressure differentials. To provide for flexibility in both radial outward movement followed by radial inward movement however, the panels are kept to a shallow inward-bow to accommodate a response to the changing internal pressure and temperatures of the pasteurization process.

The increase in temperature after capping, which is sustained for some time, softens the plastic material and therefore allows the inwardly curved panels to flex more easily under the induced force. It is disclosed that too much curvature would prevent this, however. Permanent deformation of the panels when forced into an opposite bow is avoided by the shallow setting of the bow, and also by the softening of the material under heat. The amount of force transmitted to the walls of the container is therefore once again determined by the amount of flex available in the panels, just as it is in a standard hot-fill bottle. The amount of flex is limited, however, due to the need to keep a shallow curvature on the radial profile of the panels. Accordingly, the bottle is strengthened in many standard ways.

U.S. Pat. No. 5,303,834 (Krishnakumar et al.) discloses still further "flexible" panels that can be moved from a convex position to a concave position, in providing for a "squeezable" container. Vacuum pressure alone cannot invert the panels, but they can be manually forced into inversion. The panels automatically "bounce" back to their original shape upon release of squeeze pressure, as a significant amount of force is required to keep them in an inverted position, and this must be maintained manually. Permanent deformation of the panel, caused by the initial convex presentation, is avoided through the use of multiple longitudinal flex points.

U.S. Pat. No. 5,971,184 (Krishnakumar et al.) discloses still further "flexible" panels that claim to be movable from a convex first position to a concave second position in providing for a grip-bottle comprising two large, flattened sides. Each panel incorporates an indented "invertible" central portion. Containers such as this, whereby there are two large and flat opposing sides, differ in vacuum pressure stability from hot-fill containers that are intended to maintain a generally cylindrical shape under vacuum draw. The enlarged panel side wails are subject to increased suction and are drawn into concavity more so than if each panel were smaller in size, as occurs in a 'standard' configuration comprising six panels on a substantially cylindrical container. Thus, such a container structure increases the amount of force supplied to each of the two panels, thereby increasing the amount of flex force available. Even so, the convex portion of the panels must still be kept relatively flat, however, or the vacuum force cannot draw the panels into the required concavity.

The need to keep a shallow bow to allow flex to occur was previously described by Krishnakumar et al. in both U.S. Pat. No. 5,303,834 and U.S. Pat. No. 5,908,128. This, in turn, limits the amount of vacuum force that is vented before strain, is placed on the container walls. Further, it is generally considered impossible for a shape that is convex in both the longitudinal and horizontal planes to successfully invert, anyhow, unless it is of very shallow convexity. Still further, the panels cannot then return back to their original convex position again upon release of vacuum pressure when the cap is removed if there is any meaningful amount of convexity in the panels. At best, a panel will be subject to being "force-flipped" and will lock into a new inverted position. The panel is then unable to reverse in direction as there is no longer the influence of heat from the liquid to soften the material and there is insufficient force available from the ambient pressure. Additionally, there is no longer assistance from the memory force that was available in the plastic prior to being flipped into a concave position.

U.S. Pat. No. 5,908,128 (Krishnakumar et al.) previously disclose the provision of longitudinal ribs to prevent such permanent deformation occurring when the panel arcs are flexed from a convex position to one of concavity. This same observation regarding permanent deformation was also disclosed in U.S. Pat. No. 5,303,834 (Krishnakumar et al.) U.S. Pat. No. 4,877,141 (Hayashi et al.) also disclosed the necessity of keeping panels relatively flat if they were to be flexed against their natural curve.

Thus, previous hot-fill containers usually include horizontal or vertical annular sections or 'ribs', to provide stiffness and increase structural support. These additional support structures create crevices and recesses in the interior of the container. When the container stores a viscous substance, such as jelly, jam, preserves, or heavy syrup, the viscous substance may become trapped in these crevices and recesses. Accordingly, a consumer may have difficulty accessing and removing a viscous substance from the container.

The present invention in contrast, allows for increased flexing of the vacuum panel side walls so that the pressure on the containers may be more readily accommodated, while eliminating as much geometry inside of the container as possible to facilitate product removal.

SUMMARY OF THE INVENTION

In an exemplary embodiment of the present invention, a container having a central longitudinal axis is disclosed. The container includes at least one deflectable flexible panel. The flexible panel projects from the longitudinal axis to pass through at least three curves including a first curve having a first constant radius, a second curve having a second varying radius, and a third curve having a third constant radius that is lesser than the first radius.

In another exemplary embodiment, the container comprises an enclosed base portion. A body portion extends upwardly from the base portion. The body portion includes a central longitudinal axis and a plurality of flexible panels. A top portion has a finish extending upwardly from the body portion. The flexible panels have an initial portion that passes through a first curve having a first constant radius, a middle portion arranged below the initial portion that passes through a second curve having a second varying radius, and a tail portion arranged below the middle portion that passes through a third curve having a third constant radius that is lesser than the first constant radius.

According to another exemplary embodiment, the container has a central longitudinal axis. The container includes at least one deflectable flexible panel. The flexible panel projects from the longitudinal axis to pass through at least three curves including, at an initial portion, a first curve having a first constant radius, at a middle portion, a second curve having a second varying radius, and at a tail portion, a third curve having a third constant radius that is lesser than the first radius. The middle portion is adapted to provide a stiff point whereby the panel accommodates a vacuum-induced volumetric shrinkage of the container resulting from a hot-filling, capping and cooling thereof. After cooling, the third radius becomes nearly the same as the first radius.

Further features and advantages of the invention, as well as the structure and operation of various embodiments of the invention, are described in detail below with reference to the accompanying drawings.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF AN EXEMPLARY EMBODIMENT OF THE PRESENT INVENTION

A preferred embodiment of the invention is discussed in detail below. While specific exemplary embodiments are discussed, it should be understood that this is done for illustration purposes only. A person skilled in the relevant art will recognize that other components and configurations can be used without parting from the spirit and scope of the invention.

Figure 2:
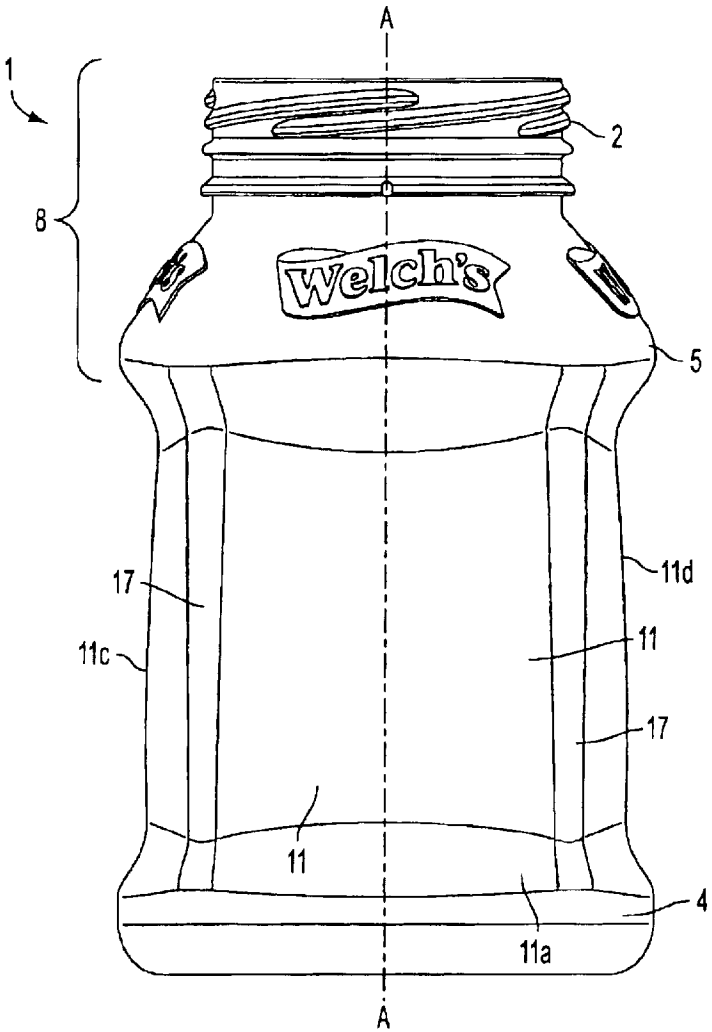
FIG. 2 depicts a side view of an exemplary embodiment of a container according to the present invention.
Figure 1:
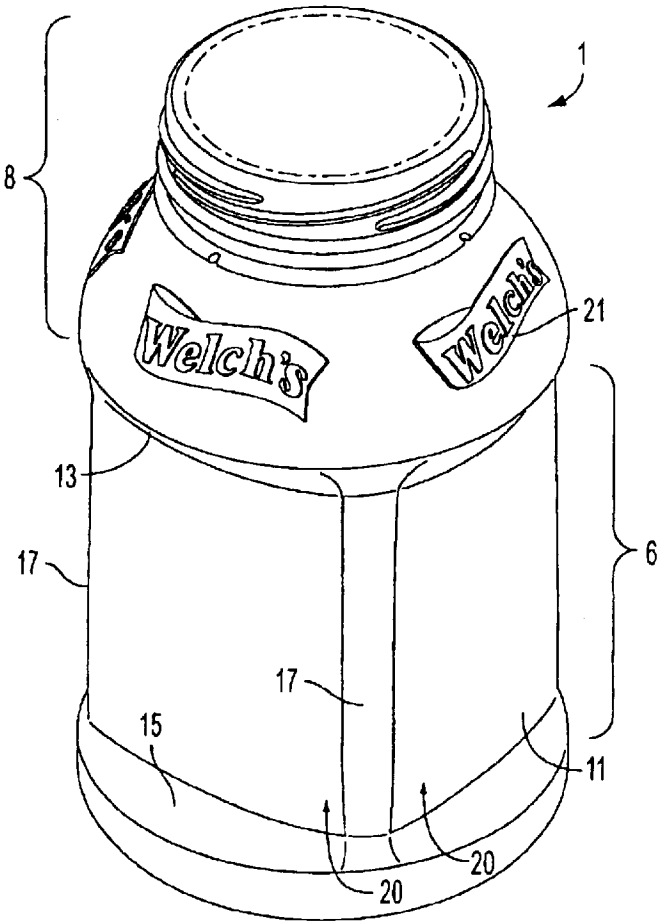
FIG. 1 depicts an isometric view of an exemplary embodiment of a container according to the present invention.

Referring now to the drawings, a preferred embodiment of a container incorporating flexible side panels is indicated generally in FIGS. 1 and 2, as generally having many of the well known features of hot-fill containers. The container 1 comprises a base 4 for supporting the container 1. The container 1 has a longitudinal axis (A—A) when the container 1 is standing upright on its base 4. A body 6 extends upwardly from the base 4.

A top portion 8 finishes upwardly from the body 6 and may include a threaded neck 2 for filling and dispensing fluid. Neck 2 also is sealable with a cap (not shown). The preferred container further comprises a shoulder 5 located below neck 2 and above base 4. The body 6 is defined by roughly rectangular sides 20 that connect shoulder 5 and base 4. The sides 20 of the preferred container may include at least one label mounting area. A label or labels can be applied to one or more of the label mounting areas using methods that are well known to those skilled in the art, including shrink wrap labeling and adhesive methods. As applied, the label extends either around the entire body of the container or extends over the entirety or a portion of the side 20.

The container 1 is preferably a pressure-adjustable container, in particular a 'hot-fill' container that is adapted to be filled with a liquid or other substance at a temperature above room temperature. The container 1 may be formed in a blow mold and may be produced from a polyester or other plastic material, such as a heat set polyethylene terepthalate (PET). Generally, the body comprises at least one vacuum or flexible panel 11. In the embodiment shown in FIGS. 1 and 2, the sides 20 are each substantially comprised of flexible panels 11. Each flexible panel 11 may be generally rectangular in shape and is adapted to flex inwardly upon filling the container with a hot-fill liquid, capping the container, and subsequent cooling of the liquid. During the hot fill process the flexible panel 11 operates to compensate for the hot-fill vacuum.

In the embodiment illustrated in FIGS. 1 and 2, the body 6 includes two pairs of flexible panels. The panels 11 in each pair are arranged on opposite sides of the container 1 from each other. The flexible panels 11 of each pair are arranged in between the flexible panels of the other pair. The left panel 11*c* and the opposed right panel 11*d* are shown in FIG. 2. The front panel 11*a* is opposed to a rear panel; the front panel 11*a* is shown, but the rear panel is not shown in FIG. 2. Accordingly, the body 6 may suitably comprise a hollow body formed generally in the shape of a rectangle, roughly a rectangular parallelepiped shape. Four panels, the left panel 11*c*, front panel 11*a*, right panel 11*d* and rear panel (not shown), are provided around the body 6. The left panel 11*c*, front panel 11*a*, right panel 11*d* and rear panel form the sides of the rectangular body and are joined with each other at their side edges 17. Alternatively, any number of flexible panels 11 may be provided and the body may have any other suitable shape. For example, one pair of flexible panels may be provided on opposite sides of the container, with generally cylindrical surfaces formed therebetween.

The flexible panels 11 preferably comprise the entire area of the sides 20. As shown in FIGS. 1 and 2, top and bottom edges 13, 15 of the flexible panel 11 smoothly merge with the shoulder 5 of top portion 8 and base 4, respectively. Side edges 17 of the flexible panels 11 smoothly merge with side edges 17 of adjacent flexible panels. Adjacent flexible panels 11 should be joined with each other via a rounded or smooth edge. Preferably, no other geometry is present in the body 6 except for flexible panels 11 and their junctions with each other. The joining of adjacent flexible panels 11 can create a rigid post or column at side edges 17. The post or column increases the container's ability to withstand top load forces.

Accordingly, the body 6 is substantially comprised of the flexible panels 11. The flexible panels 11 have an interior surface that is substantially smooth. That is, preferably no ribs, recesses or other structure are provided on an interior surface of the panel. An exterior surface of the panel 11 is also preferably substantially smooth. By minimizing geometry inside of the container and streamlining the body and interior surface of the container, the removal of a substance from the container is facilitated.

In the embodiment shown in FIGS. 1 and 2, a design or logo 21 is arranged in the top portion 8 of the container 1. Providing the logo 21 in the top portion 8 of the container 1 does not hinder the removal of substance from the container 1. The top portion 8 can be angled such that gravity causes any substance that may be present in the logo 21 to slide down into the container as the level of the substance in the container 1 decreases.

Figure 3:
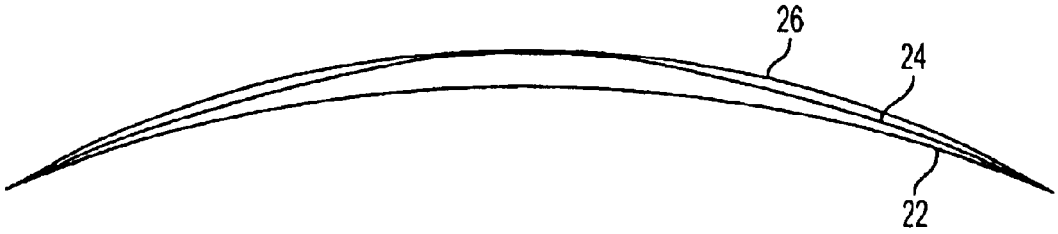
FIG. 3 depicts a longitudinal view of an exemplary embodiment of a flexible panel according to the present invention.

Flexible panel 11 preferably passes through at least three curves as it extends along the longitudinal axis A—A between the top portion 8 and the base 4 of the container 1. FIG. 3 is a view along the longitudinal axis A—A of the container 1 from the top portion 8 illustrating a first curve 22, a second curve 24, and a third curve 26 through which the flexible panel 11 passes. The first curve 22 has a first radius that is constant. The third curve 26 has a third radius that is also constant and lesser than or equal to the first radius. The second curve 24 has a second radius that varies along the length of the second curve 24. As can be seen from figure 3, the radius of the second curve 24 varies, but second curve 24 projects from the longitudinal axis A—A to an extent greater than or equal to the first curve 22, and the second curve 24 projects from the longitudinal axis A—A to an extent lesser than or equal to the third curve 26. The endpoints of the first curve 22, the second curve 24, and the third curve 26 are the points where the flexible panel 11 meets the side edges 17. The endpoints of the first curve 22, the second curve 24 and the third curve 26 can lie in the same plane which is parallel to the longitudinal axis A—A of the container 1. A longitudinal direction of the container 1 is a direction parallel to the longitudinal axis A—A.

Figure 4A:
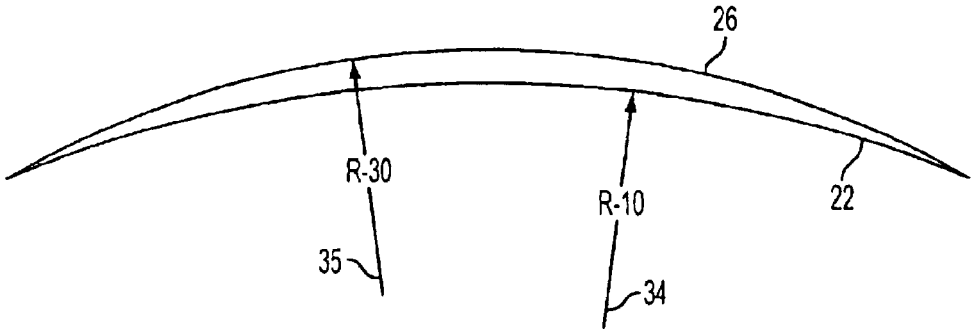
FIG. 4A depicts a detailed longitudinal view of an exemplary embodiment of a flexible panel according to the present invention.

FIG. 4A is a detailed view of the first curve 22 and the third curve 26. The first radius 34 of the first curve 22 is shown. The third radius 35 of the third curve 26 is shown.

Figure 4B:
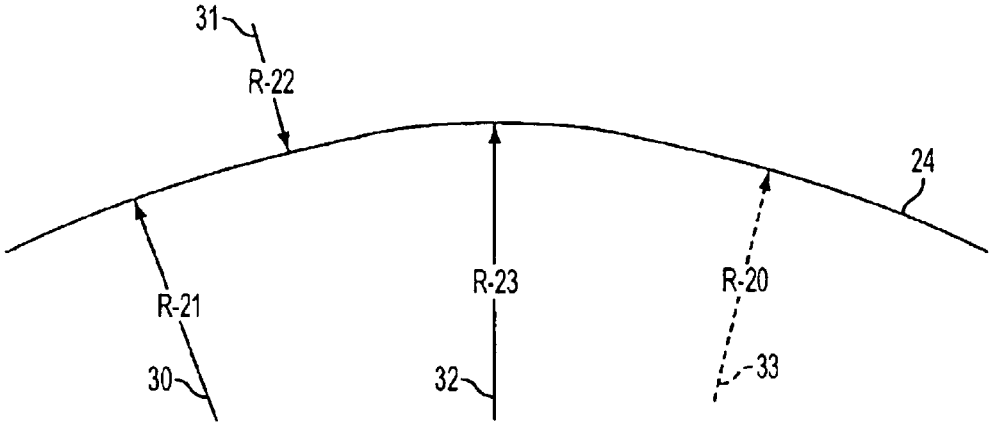
FIG. 4B depicts a detailed longitudinal view of an exemplary embodiment of a flexible panel according to the present invention.

FIG. 4B is a detailed view of the second curve 24. The second varying radius 33 of the second curve 24 is shown. Second curve 24 is a compound curve comprised of a plurality of arcs. Preferably at least three arcs, a first arc 30, a second arc 31 and a third arc 32, comprise the second curve 24. The first arc 30 is arranged at one end of the second curve 24 and preferably has a constant radius. The third arc 32 is arranged at a midpoint of the second curve 24, with the second arc 31 arranged between the first arc 30 and the third arc 32. The third arc 32 also preferably has a constant radius. The radius of the third arc 32 should be less than the radius of the first arc 30, and is preferably less than the radiuses of all other arcs comprising the second curve 24.

The second arc 31 may be slightly concave with respect to the first and third arcs 30, 32. A radius of the second arc 31 is typically very large and may approach infinity. Thus, the second arc 31 may appear almost linear. Although only the arcs on the left-hand side of second curve 24 are labeled in FIG. 4B, the second curve 24 is preferably symmetrical and corresponding arcs are present on the right hand side of second curve 24. Thus, the second curve 24 can be symmetrical about a midpoint of second curve 24, so that the left hand side and right hand side of second curve 24 are mirror images of each other.

The curves are called first, second, etc. for identification purposes. This terminology does not necessarily indicate a numerical order in which the flexible panel 11 passes through the curves.

Figure 5:
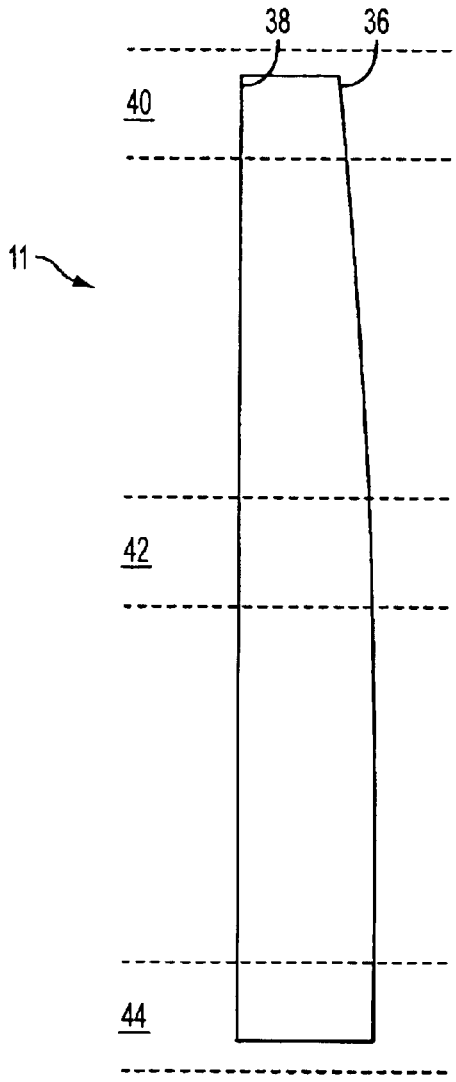
FIG. 5 depicts a side view of an exemplary embodiment of a flexible panel according to the present invention.

FIG. 5 shows a side view of a flexible panel 11 passing through the first, second and third curves. The flexible panel 11 includes an exterior surface 36 and an interior surface 38. The interior surface is preferably substantially planar as shown in the figure, although it may also be arcuate. The flexible panel 11 includes an initial portion 40, a middle portion 42 and a tail portion 44. The flexible panel 11 projects or arcs different distances from a plane defined by the longitudinal axis of the container 1. The projection of the flexible panel 11 increases along the longitudinal axis of the container. The projection of the flexible panel 11 from the plane of the longitudinal axis follows the first, second and third curves. The curves are transverse to the longitudinal axis A—A of the container. The flexible panel 11 passes through the curves between its side edges 17.

The flexible panel 11 can have no reinforcement ribs or grooves. The entire area of the interior surface 38 can be substantially smooth.

The initial portion 40 is arranged in the vicinity of the top portion 8 of the container 1. In at least part of the initial portion 40, the projection of the flexible panel 11 follows the first curve 22. The first curve 22 extends between the side edges 17 of panel 11. The projection of the flexible panel 11 follows the first curve 22 between side edges 17 and projects from the longitudinal axis of the container 1 according thereto.

The middle portion 42 is arranged below the initial portion 40. The amount of projection from the longitudinal axis in the middle portion 42 of the container is greater than the amount of projection in the initial portion 40 as shown in FIG. 5. In at least a part of the middle portion 42, the projection of the flexible panel 11 from the longitudinal axis follows the second curve 24. The second curve 24 extends between the side edges 17 in the middle portion 42. The flexible panel 11 follows the second curve 24 and projects from the longitudinal axis of the container 1 according thereto.

The tail portion 44 is arranged below the middle portion 42. The projection of the panel 11 from the longitudinal axis in at least part of the tail portion 44 follows the third curve 26. The third curve 26 extends between the side edges 17 of the tail portion 44. The projection in the tail portion 44 follows the third curve 26 and projects from the longitudinal axis according thereto.

The flexible panel 11 preferably follows the first, second and third curves from one of its side edges 17 to the other side edge 17. At the side edges 17, the panel 11 is connected to an adjacent panel 11. The amount of projection from the longitudinal axis of the container in the tail portion 44 is greater than the amount of projection in either the initial portion 40 or the middle portion 42 before a hot-fill process.

By passing the flexible panel 11 through these three curves, a stronger panel 11 is attained. The varying radius of the panel 11 in the middle portion 42 provides strength to the panel 11. By strengthening this area, a means for the panel to retain its outward concavity is provided. This concave shape aids in simplifying the labeling process. Also, the shape of the panel provides rigidity. The panel can provide the structural support for the body, without the need for ribs, pillars or other support members.

For example, upon hot fill of the container, the middle portion 42 of the flexible panel 11 provides a stiff point which forces the tail portion 44 to move and change radius to accommodate the change in internal volume of the container. The tail portion 44 is compressed inwardly. This change in radius causes the tail portion 44 to become nearly the same in radius as the initial portion. Thus, the panel becomes almost symmetrical and maintains a convex shape.

Figure 6:
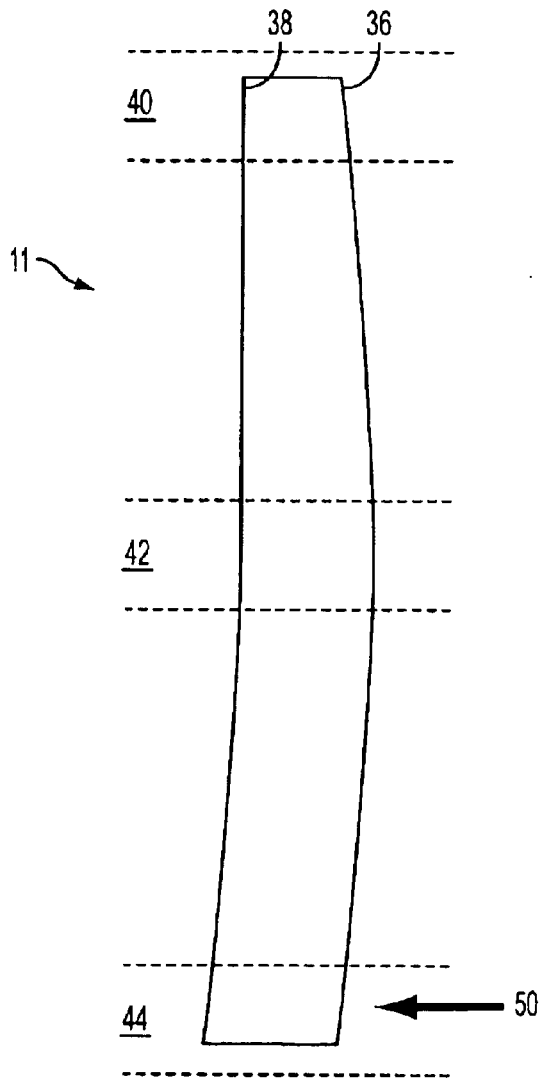
FIG. 6 depicts a side view of an exemplary embodiment of a flexible panel according to the present invention.

FIG. 6 is a side view of a flexible panel 11 that is in a compressed position due to applied vacuum pressure. The tail portion 44 of the container 1 deflects in the direction of arrow 50. The amount of deflection of tail portion 44 may vary. Tail portion 44 is preferably deflected such that it projects from the longitudinal axis of the container 1 an amount substantially the same as the initial portion 40. Thus, as shown in FIG. 6, the projection of the flexible panel 11 is substantially symmetrical about the middle portion 42.

It will be appreciated that the deflection of the tail portion 44 may progress steadily in response to the gradual contraction of the volume of the contents of the container 1 during cooling. This is in contrast to a panel which 'flips' between two states. The gradual deflection of the tail portion 44 to and from inversion in response to a relatively small pressure differential in comparison to panels which "flip", means that less force is transmitted to the side walls of the container 1. This allows for less material to be necessarily utilized in the container construction, making production cheaper. Consequentially, less failures under load may occur for the same amount of container material.

Furthermore, the reduced pressure differential required to deflect the projecting portion 44 allows for a greater number of flexible panels 11 to be included on a single container 1. Thus, the flexible panels 11 do not need to be large in size, nor reduced in number on a container structure, providing more flexibility in container design. At least one of the flexible panels 11 can be featureless.

While various embodiments of the present invention have been described, above, it should be understood that they have been presented by way of example only, and not limitation. Thus, the breadth and scope of the present invention should not be limited by any of the above-described exemplary embodiments, but should instead be defined only in accordance with the following claims and their equivalents.

What is claimed is:

1. A container having a central longitudinal axis, the container including at least one deflectable flexible panel, the flexible panel projecting from the longitudinal axis to pass through at least three curves including a first curve having a first constant radius, a second curve having a second varying radius, and a third curve having a third constant radius that is lesser than the first radius, wherein the flexible panel has no reinforcement ribs or grooves.

2. The container of claim 1, wherein the second curve is comprised of a plurality of arcs.

3. The container of claim 2, wherein the second curve includes an arc at its midpoint with a radius which is smaller than the radiuses of all other arcs in the second curve.

4. The container of claim 1, wherein the second curve projects from the longitudinal axis to a greater extent than the first curve.

5. The container of claim 1, wherein the second curve projects from the longitudinal axis to a lesser extent than the third curve.

6. The container of claim 1, wherein the second curve comprises a compound curve.

7. The container of claim 6, wherein the compound curve comprises at least first, second and third arcs.

8. The container of claim 7, wherein the second arc is arranged in between the first and third arcs.

9. The container of claim 8, wherein the second arc is concave with respect to the other arcs in the curve.

10. The container of claim 8, wherein the second arc has a radius greater than a radius of the first arc and a radius of the third arc.

11. The container of claim 10, wherein the third arc has a constant radius.

12. The container of claim 10, wherein a radius of the third arc is less than a radius of the first arc.

13. The container of claim 10, wherein the third arc is arranged at a midpoint of the second curve and has a radius smaller than the first and second arcs.

14. The container of claim 13, wherein the second curve is symmetrical.

15. The container of claim 1, wherein endpoints of the first curve, endpoints of the second curve, and endpoints of the third curve lie in the same plane parallel to the central longitudinal axis of the container.

16. The container of claim 1, wherein the second curve is comprised of at least three arcs on at least one side of a midpoint of the second curve and wherein at least one pair of arcs on the at least one side of the midpoint of the second curve are separated from each other by an arc having a radius different than either member of the pair of arcs.

17. A container having a central longitudinal axis, the container comprising at least one deflectable flexible panel, the flexible panel having an exterior surface and an interior surface and projecting from the longitudinal axis to pass through at least three curves including a first curve having a first constant radius, a second curve having a second varying radius, and a third curve having a third constant radius that is lesser than the first radius, wherein an entire area of the interior surface is substantially smooth.

18. The container of claim 17, comprising a first pair of flexible panels arranged opposite each other and a second pair of flexible panels arranged opposite each other, each flexible panel in each pair being adjacent to the flexible panels of the other pair.

19. The container of claim 18, wherein a surface of the at least one flexible panel is smooth.

20. The container of claim 17, wherein an amount the exterior surface projects from a plane defined by the longitudinal axis increases in a longitudinal direction of the container.

21. The container of claim 17, wherein the at least one flexible panel is substantially rectangular in shape.

22. A container, comprising:

an enclosed base portion;

a body portion extending upwardly from the base portion, the body portion including a central longitudinal axis and at least one flexible panel being featureless and having an initial portion that passes through a first curve having a first constant radius, a middle portion arranged below the initial portion that passes through a second curve having a second varying radius, and a tail portion arranged below the middle portion that passes through a third curve having a third constant radius that is lesser than the first constant radius; and a top portion with a finish extending upwardly from the body portion.

23. The container of claim 22, comprising four flexible panels arranged around the body portion.

24. The container of claim 22, wherein a cross-section of the body portion in a plane perpendicular to the longitudinal axis is rectangular.

25. The container of claim 22, wherein the at least one flexible panel accommodates a vacuum-induced volumetric shrinkage of the container resulting from a hot-filling, capping and cooling thereof.

26. The container of claim 25, wherein after cooling the third radius becomes nearly the same as the first radius.

27. The container of claim 25, wherein after cooling the at least one flexible panel projects from the longitudinal axis in a symmetrical manner about the middle portion.

28. The container of claim 22, wherein the second curve comprises a compound curve.

29. The container of claim 28, wherein the compound curve comprises at least first, second and third arcs.

30. The container of claim 29, wherein the second arc is arranged in between the first and third arcs.

31. The container of claim 30, wherein a radius of the third arc is less than a radius of the first arc.

32. The container of claim 30, wherein the second arc has a radius greater than a radius of the first arc and a radius of the third arc.

33. The container claim 32, wherein the third arc is arranged at a midpoint of the second curve and has a radius smaller than the first and second arcs.

34. The container of claim 33, wherein the third arc has a constant radius.

35. The container of claim 33, wherein the second arc is concave with respect to the other arcs in the curve.

36. The container of claim 22, wherein the second curve projects from the longitudinal axis to a greater extent than the first curve.

37. The container of claim 22, wherein the second curve projects from the longitudinal axis to a lesser extent than the third curve.

38. The container of claim 22, comprising a plurality of flexible panels, wherein the flexible panels have side edges arranged opposite each other, the side edges of each flexible panel being connected to side edges of an adjacent flexible panel.

39. The container of claim 38, wherein the first curve extends between the side edges in the initial portion.

40. The container of claim 38, wherein the second curve extends between the side edges in the middle portion.

41. The container of claim 38, wherein the third curve extends between the side edges in the tail portion.

42. The container of claim 22, wherein endpoints of the first curve, end points of the second curve, and endpoints of the third curve lie in the same plane parallel to the central longitudinal axis of the container.

43. The container of claim 22, wherein the second curve is comprised of at least three arcs on at least one side of a midpoint of the second curve and wherein at least one pair of arcs on the at least one side of the midpoint of the second curve are separated from each other by an arc having a radius different than either member of the pair of arcs.

44. A container having a central longitudinal axis, the container including at least one deflectable flexible panel, the flexible panel projecting from the longitudinal axis to pass through at least three curves including, at an initial portion, a first curve having a first constant radius, at a middle portion, a second curve having a second varying radius, and at a tail portion, a third curve having a third constant radius that is lesser than the first radius, the middle portion being adapted to provide a stiff point whereby the panel accommodates a vacuum-induced volumetric shrinkage of the container resulting from a hot-filling, capping and cooling thereof and after cooling the third radius becomes nearly the same as the first radius.

45. The container of claim 44, wherein the flexible panel is convex after cooling.

46. The container of claim 44, wherein endpoints of the first curve, endpoints of the second curve, and endpoints of the third curve lie in the same plane parallel to the central longitudinal axis of the container.

47. The container of claim 44, wherein the second curve is comprised of at least three arcs on at least one side of a midpoint of the second curve and wherein at least one pair of arcs on the at least one side of the midpoint of the second curve are separated from each other by an arc having a radius different that either member of the pair of arcs.

* * * * *